US006253462B1

(12) United States Patent
Schwarz

(10) Patent No.: US 6,253,462 B1
(45) Date of Patent: Jul. 3, 2001

(54) DEVICE AND METHOD FOR CLEANING OR DRYING WORKPIECES

(75) Inventor: Joachim Schwarz, Freudenstadt (DE)

(73) Assignee: Mafac Ernst Schwarz GmbH & Co. KG, Alpirsbach (DE)

( * ) Notice: Subject to any disclaimer, the term of this patent is extended or adjusted under 35 U.S.C. 154(b) by 0 days.

(21) Appl. No.: 09/402,940

(22) PCT Filed: Apr. 8, 1998

(86) PCT No.: PCT/DE98/01006

§ 371 Date: Jan. 10, 2000

§ 102(e) Date: Jan. 10, 2000

(87) PCT Pub. No.: WO98/45059

PCT Pub. Date: Oct. 15, 1998

(30) Foreign Application Priority Data

Apr. 9, 1997 (DE) ..... 197 14 603

(51) Int. Cl.[7] ..... F26B 3/00

(52) U.S. Cl. ..... 34/348; 34/350; 34/85; 34/92; 34/227

(58) Field of Search ..... 34/343, 348, 350, 34/85, 92, 218, 227

(56) References Cited

U.S. PATENT DOCUMENTS

| | | | | |
|---|---|---|---|---|
| 4,983,222 | * | 1/1991 | Green et al. | 134/22.19 |
| 5,180,438 | * | 1/1993 | Hockh et al. | 134/21 |
| 5,485,858 | * | 1/1996 | Schmidt | 134/107 |
| 5,524,652 | * | 6/1996 | Neubauer | 134/95.2 |
| 5,653,820 | * | 8/1997 | Higashino | 134/29 |
| 5,702,535 | * | 12/1997 | Gary et al. | 134/10 |

* cited by examiner

*Primary Examiner*—Pamela Wilson
(74) *Attorney, Agent, or Firm*—Foley Hoag & Eliot, LLP

(57) ABSTRACT

A device and method for cleaning and drying workpieces in a treatment vessel in which a reduced pressure can be provided. During the cleaning process, a liquid bath is formed in the treatment vessel (1), said liquid bath at least partially surrounding the work pieces, and cleaning fluid and optionally a gaseous medium are introduced into the treatment vessel under excess pressure via a spray unit. The workpiece support moves up and down or rotates so that the work pieces are subjected alternately to different cleaning processes in the liquid bath and a gas space located above said liquid bath.

17 Claims, 5 Drawing Sheets

DEVICE AND METHOD FOR CLEANING OR DRYING WORKPIECES

FIELD OF THE INVENTION

The present invention relates to a device and a method for cleaning and drying workpieces.

BACKGROUND OF THE INVENTION

Removal of manufacturing residues, for example oil, grease or chips from workpieces which have fine structural features with bores, recesses, fissures and other openings, has until now essentially been performed using solvent-based cleaning methods. The solvents dissolve grease and oil residues, but also facilitate penetration of the cleaning fluid into very small capillary openings and fissures because of the small surface tension. Such cleaning methods, however, disadvantageously use chemical solvents which require a complex post-treatment or disposal of the cleaning fluid.

The known devices and methods for cleaning workpieces without using a solvent are inadequate for cleaning workpieces with filigree openings and surface structures.

A device and a method for cleaning workpieces which does not require a solvent, is known from DE 43 17 862 A1. Workpieces are here introduced in a wash tank which is then closed air-tight and a reduced pressure is generated in the tank. This reduced pressure causes liquid to be drawn into the wash tank through a pipe connection; subsequently air is blown into the liquid bath.

DE 92 17 047 U1 describes a device for cleaning workpieces wherein the workpieces are surrounded by a bath with a wash liquid into which a gaseous medium is blown under an excess pressure. A reduced pressure can be generated in an air space above the bath containing the wash liquid.

DE 37 02 675 A1 describes a device for wet cleaning workpieces wherein a turbulent flow is produced in a immersion bath using a liquid jet, wherein the workpieces to be cleaned are arranged in the immersion bath.

EP 0 507 294 A1 discloses a device for cleaning work pieces which includes a treatment vessel and a workpiece support arranged in the treatment vessel for receiving workpieces. A spray unit which is disposed in the treatment vessel and has discharge nozzles for discharging a cleaning fluid, is arranged so as to be rotatable above the work piece support. Also provided is a flooding pipe for entirely or partially flooding the cleaning vessel with a cleaning fluid. The device described above can be used to carry out a method for cleaning workpieces wherein the workpieces are cleaned using an immersion process by flooding the cleaning vessel or, alternatively, a spray process by applying to the work pieces a cleaning jet from a spray cleaning unit.

DE 44 46 587 A1 describes a cleaning device with a tank which can be used to clean a charge using a cleaning liquid supplied through nozzles of a supply line. A reduced pressure can be generated in the treatment vessel. A discharge pipe is located in the lower section of the treatment vessel, with the discharge pipe being either connected to the supply line via a circulation pump or via a pump to a storage tank, wherein the storage tank is in turn connected to the supply line via a pump.

The known devices and methods have the disadvantage of not being very effective for cleaning workpieces having small surface features and, in particular, for cleaning small workpieces which are introduced into the cleaning vessel in the form of loose parts.

It is therefore an object of the present invention to provide a device for cleaning workpieces which allows reliable cleaning of small workpieces and of workpieces having filigree surface structures. The device should also operate reliably when cleaning fluids that do not contain solvents are used, and should eliminate the disadvantages described above.

It is another object of the invention to provide a method for cleaning and drying workpieces which can be carried out using the device of the pr invention.

SUMMARY OF THE INVENTION

Accordingly, the device includes a treatment vessel in which a workpiece support for receiving the workpiece to be cleaned is arranged. A spray unit having discharge nozzles for discharging cleaning fluids and/or a gaseous medium is arranged inside the treatment vessel which has a controllable liquid flow and wherein a reduced pressure can be generated. The workpiece support and/or the spray unit are also arranged so as to be able to rotate in the treatment vessel.

With the device of the invention, even small workpieces can be reliably cleaned and grease and oil residues can be removed from small recesses and openings. For this purpose, a liquid bath is provided in the treatment vessel which at least partially surrounds the workpieces supported by the workpiece support. At the same time, when a reduced pressure is generated in the region above the liquid bath using a vacuum pump connected to a first suction port, a cleaning fluid and, as needed, also a gaseous medium are introduced through the spray unit into the liquid bath and into the region above the liquid bath. The impact of the cleaning fluid discharged from the spray unit and impinging on the workpieces causes a spontaneous evaporation in the region above the liquid bath, wherein the released energy causes the gas particles to impact the workpieces with a high velocity, thereby producing a thorough cleaning effect. The cleaning fluid and the gaseous medium, which may also be introduced, cause turbulence and cavitation effects in the liquid bath which result in an explosive release of contaminants that adhere to the workpieces and of contaminants that are present in the capillary inclusions of the workpieces. By rotating or periodically raising and lowering the workpiece support, the workpieces are permanently exposed to the different cleaning processes both in the liquid bath and above the liquid bath. In particular, the workpieces pass an active boundary region which exists between the liquid bath and the reduced pressure region located above the bath.

For maintaining an at least approximately constant liquid level in spite of the continuous introduction of cleaning fluid, a controllable liquid flow is provided which discharges per unit time a quantity of liquid which corresponds to the quantity of liquid introduced. The liquid discharge port preferably also includes a valve which is opened and closed periodically.

The device according to the invention has the additional advantage that it can be used not only to clean workpieces, but also to dry the cleaned workpieces.

For this purpose, after the cleaning fluid or the liquid bath is discharged, a gaseous medium is introduced into the treatment vessel under excess pressure through the discharge nozzles of the spray unit, wherein the gas jet impinging on the workpieces removes the residual liquid adhering to the workpieces which is then withdrawn. The residual liquid is preferably withdrawn using the vacuum pump or another suction device provided according to one of the embodiments of the invention, wherein the additional suction device is connected to a second suction port of the treatment vessel. In particular, the second suction device is provided for rapidly withdrawing the liquid vapors that remain in the treatment vessel immediately following the cleaning process. A reduced pressure produced by the vacuum pump in the treatment vessel accelerates the evaporation of the residual liquid that were removed from the workpieces by the gas jet. By rotating the spray unit in the treatment vessel, gas jets are applied to the workpieces from continuously changing directions so as to dry the workpieces as thoroughly as possible. The workpieces can also be continuously intermixed by simultaneously rotating the workpiece support, in particular when loose parts are cleaned and/or dried, so that during the drying process all workpieces are exposed to the gas jets.

Advantageously, the treatment vessel may include heating devices disposed on the outside of the vessel for heating the treatment vessel during the drying process.

According to another embodiment of the invention, heat radiators are arranged inside the treatment vessel, whereby heat radiation is directed towards the workpieces during the drying process. This feature and the reduced pressure in the treatment vessel promote evaporation of the residual liquid adhering to the workpieces. Advantageously, the heat radiators in the treatment vessel can be rotated about the workpiece support.

It is another object of the present invention to provide a method for cleaning workpieces according to the matching claim 7 which can be carried out with the device of the invention.

According to the cleaning process of the invention, a liquid bath is provided in a treatment vessel in which a workpiece support for receiving workpieces is arranged, and a reduced pressure is generated in the treatment vessel in a region above the liquid bath. The workpiece support and the workpieces, respectively, are partially surrounded by the liquid bath.

Subsequently, cleaning fluid and/or a gaseous medium are introduced into the treatment vessel under excess pressure through discharge nozzles of a spray unit, wherein the liquid jets and the jets of the gaseous medium, respectively, are preferably directed towards the workpieces. The workpiece support is moved during this process in the treatment vessel in such a way that the workpieces alternately pass regions above and below a liquid level of the liquid bath so as to be exposed alternately to the different cleaning processes which occur above, below and in the boundary region between the liquid bath and the reduced pressure region. The workpiece support can be moved, for example, by periodically raising and lowering and also by rotating the workpiece support.

During the cleaning process, the liquid level is preferably at least approximately maintained at a constant level to ensure that the workpieces, during the movement of the workpiece support, alternately pass the regions above and below the liquid level. The liquid bath in the treatment vessel can be provided by initially flooding the treatment vessel to a predetermined liquid level wherein the liquid level is maintained constant by controlling the liquid flow, if additional cleaning liquid is introduced. Alternatively, the liquid bath can be provided by closing the liquid discharge port at the beginning of the cleaning process until a suitable quality of cleaning liquid has been introduced into the treatment vessel through the spray unit.

Liquid vapors which form in the reduced pressure region above the liquid bath, are drawn off, wherein the reduced pressure is preferably generated using a vacuum pump. The spray unit advantageously rotates during the cleaning process, with the discharge nozzle of the spray unit preferably moving opposite to the rotation of the workpiece support.

According to another aspect of the cleaning method of the invention, the process steps disclosed above are repeated several times, wherein between the individual cleaning processes the liquid bath is discharged almost abruptly through the liquid discharge port. The suction generated in this way produces an additional cleaning effect on the workpieces. The speed with which the liquid bath is discharged, can be increased by introducing compressed air through the spray unit to generate an excess pressure.

The workpieces can be dried following the cleaning process by discharging the cleaning fluid from the treatment vessel and subsequently introducing under an excess pressure a gaseous medium through discharge nozzles of a spray unit. The liquid vapors which are produced by the gaseous jet impinging on the liquid adhering to the workpieces are removed from the treatment vessel. The vapors are preferably removed using a vacuum pump, wherein the reduced pressure generated by the vacuum pump in the treatment vessel accelerates the evaporation of the liquid residues. The workpiece support and/or the spray unit are rotated during the drying process so that workpieces which consist of loose parts are permanently and thoroughly mixed. The rotation also exposes the workpieces to the gaseous jet from all directions. However, in particular for drying sensitive workpieces, the workpiece are advantageously supported during the drying process in a stationary position, with the spray unit rotating around the workpiece support.

The drying process can be accelerated by heating the treatment vessel with heating devices disposed inside or outside of the treatment vessel.

According to another process of the invention for drying workpieces, a reduced pressure is generated in a treatment vessel in which the workpieces are received by a workpiece support, and in addition, radiant heat directed towards the workpieces is generated inside the treatment vessel. The powerful radiant heat, supported by the reduced pressure formed inside the container, promotes evaporation of the liquid adhering to the workpieces. To uniformly expose the workpieces to the radiant heat, the workpiece support and/or a device to which the heat radiators are attached, can be rotated. The liquid vapors are removed from the inside of the container. The vapors are withdrawn preferably using the vacuum pump which also generates the reduced pressure. According to an embodiment of the drying process, a gaseous medium under an excess pressure is preferably introduced into the treatment vessel through discharge nozzles of a spray unit. This has the effect that liquid residues are blown off the workpieces, with the liquid residues evaporating due to the vacuum and the applied heat and the generated liquid vapors removed using the vacuum pump. In addition, the introduction of the gaseous medium temporarily weakens the reduced pressure, wherein the vacuum pump provides an enhanced suction effect inside the container, so that the liquid vapors can be removed from the inside of the vessel more quickly.

BRIEF DESCRIPTION OF THE DRAWINGS

The device according to the invention and the method according to the invention will be described hereinafter with reference to embodiments illustrated in the figures. It is shown in.

Unless indicated otherwise, identical elements and elements having an identical function have the same reference numerals in the figures.

DESCRIPTION OF THE PREFERRED EMBODIMENT

Figure 1:
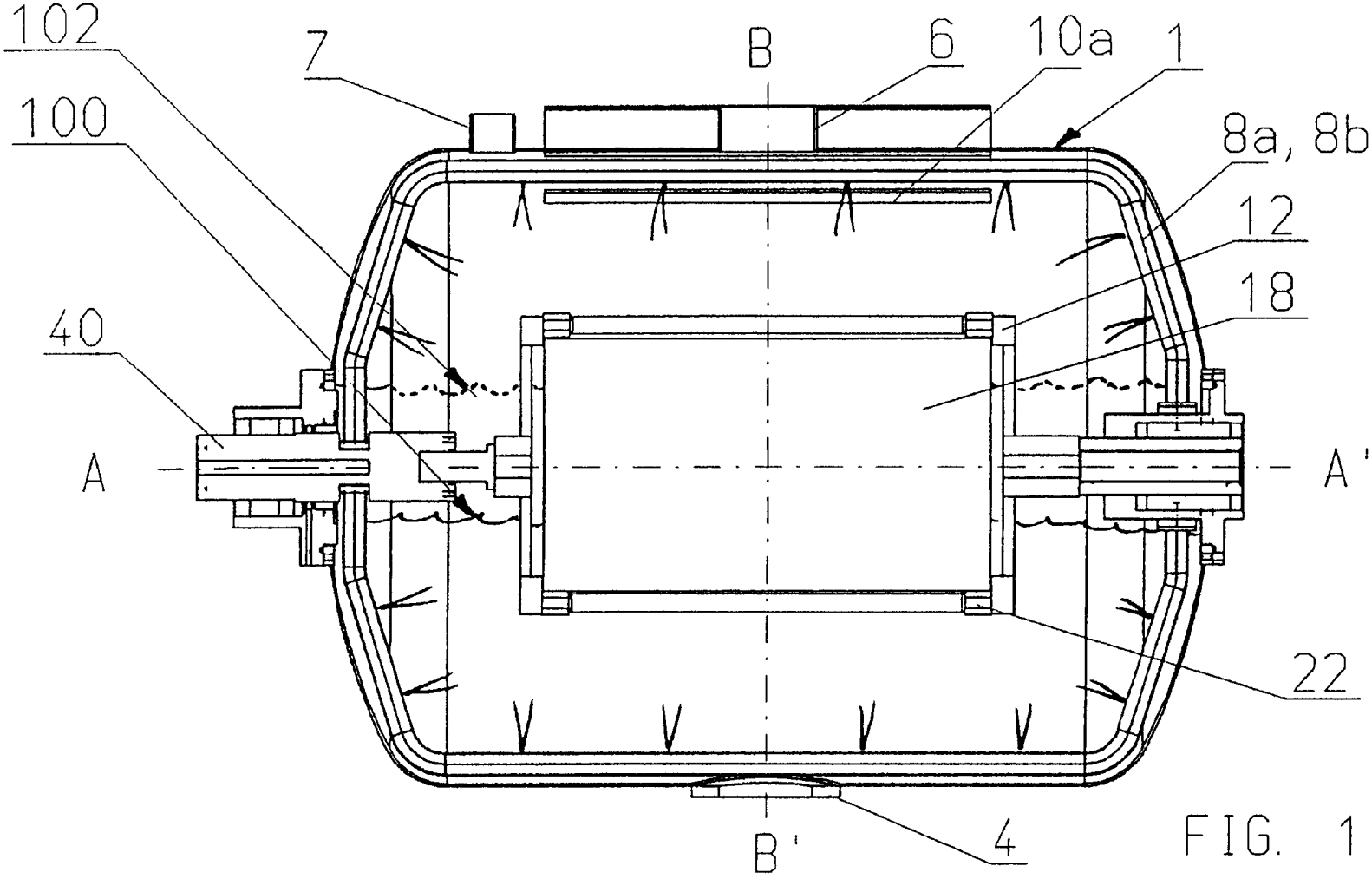
FIG. 1 an axial cross section of a device according to the invention with a cylindrical treatment vessel.
Figure 2:
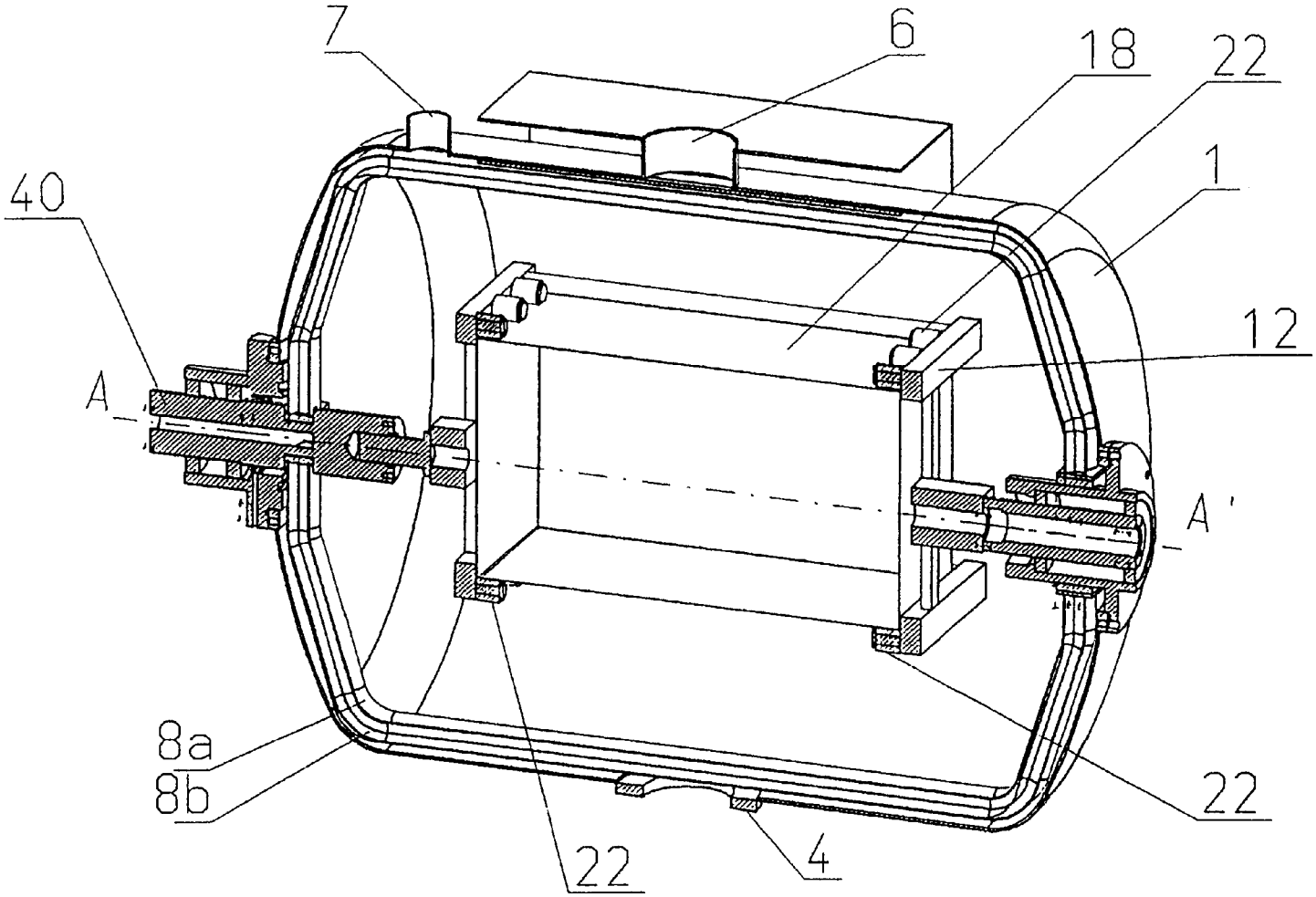
FIG. 2 a perspective view of the device according to the invention in axial cross section.
Figure 3:
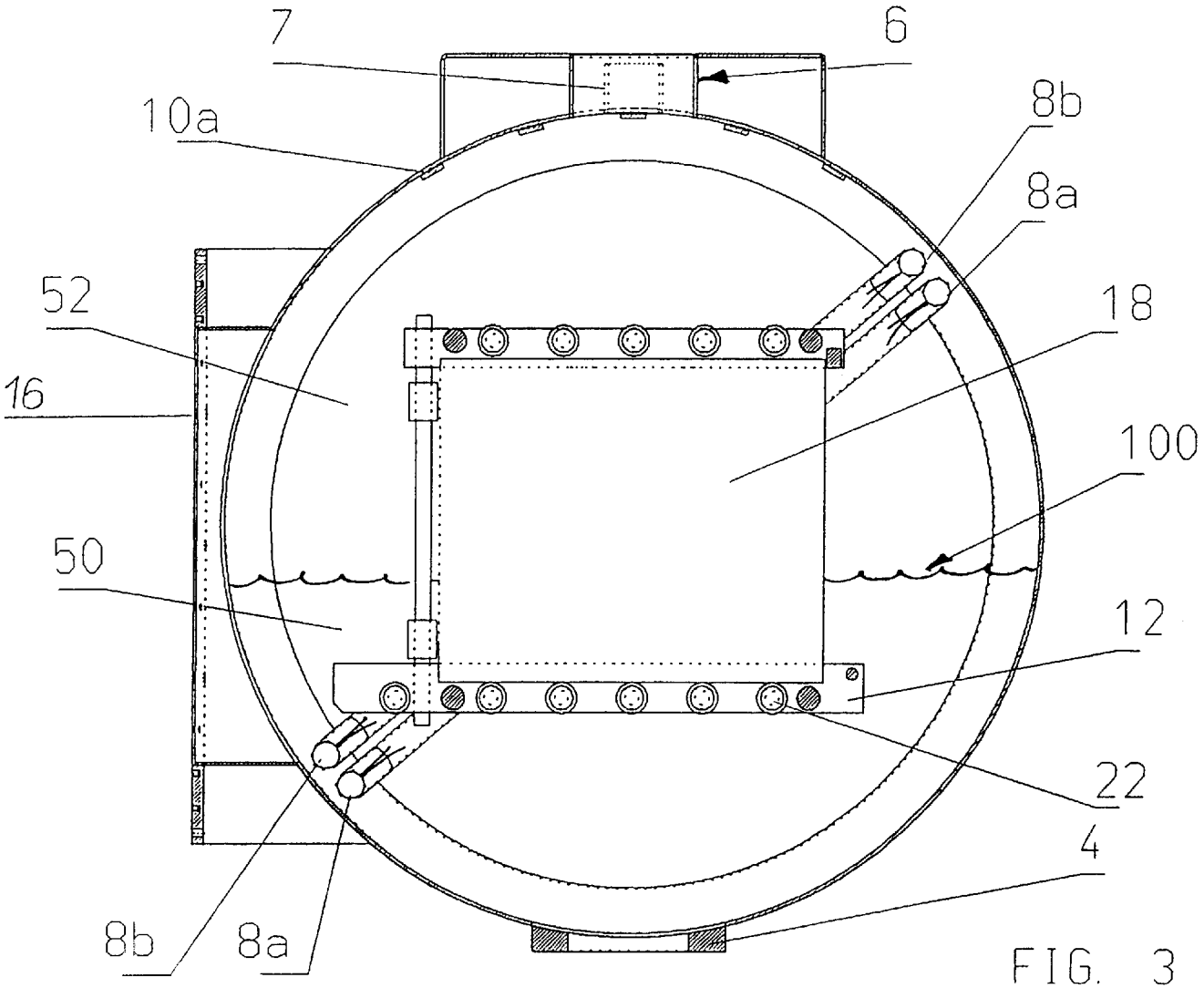
FIG. 3 a radial cross section of the device according to the invention according to a first embodiment with stationary heat radiators.

The essential components of the device of the invention will be described hereinafter with reference to FIGS. 1 to 4, wherein FIG. 3 is a cross-sectional view of the device taken along the line B–B' indicated in FIG. 1. FIG. 2 shows in addition a perspective view of the axial cross-section of the device, with the cross-sectional faces cross-hatched for clarity.

The device according to the invention has an essentially cylindrical treatment vessel 1 which includes a controllable liquid discharge port 4 and a first suction port 7 to which a vacuum pump for generating a reduced pressure inside the treatment vessel 1 can be connected. In addition, a second suction port 6 to which an additional suction device can be connected, is provided for a rapidly removing liquid vapors following a cleaning process performed with the device. The additional suction device, which may not be suitable for generating a vacuum, preferably enables a significantly greater gas exchange than the vacuum pump.

A workpiece support 12 for receiving workpieces is arranged inside the treatment vessel 1, wherein the workpiece support 12 in the treatment vessel 1 is supported for rotation about an axis A–A' extending in a longitudinal direction. The workpiece support 12 is adapted to receive large individual workpieces and also baskets 18 with loose parts, wherein the baskets are previous to liquids and gases. A spray unit 8A, 8B, for introducing cleaning fluid or a gaseous medium into the interior of the treatment vessel 1 is disposed inside the treatment vessel 1. In the embodiment illustrated in the figures, the spray unit consists of two parallel, essentially rectangular tubing loops, with one of the loops intended for discharging cleaning fluid and the other loop intended for discharging a gaseous medium. Each of the two tubing loops 8*a*, 8*b* has a plurality of discharge nozzles directed towards the workpiece support. The spray unit formed of the two tubing loops 8A, 8B is also supported for rotation about the container axis A–A'.

The treatment vessel 1 further includes on one side a closeable feed opening 16 for introducing workpieces into the treatment vessel. The workpiece support 12 has a plurality of rollers to facilitate introduction of the basket 18 which receives the workpieces, into the treatment vessel 1.

The method of the invention for cleaning workpieces will be described hereinafter with reference to the device illustrated in the figures. After the basket 18 which holds the workpieces is introduced into the treatment vessel 1, the treatment vessel 1 is flooded with a cleaning fluid to a predetermined liquid level 100, 102, wherein the workpiece support 12 and the basket 18 holding the workpieces, respectively, are partially surrounded by the liquid bath 50. Two exemplary different liquid levels are indicated in FIG. 1. The space 52 located above the liquid bath is partially evacuated using the vacuum pump which is connected to the first suction port. In addition, cleaning fluid is introduced into the interior of the vessel under excess pressure through the discharge nozzles of one of the tubing loops of the spray unit 8A, 8B. The cleaning fluid is supplied from the outside through a central shaft 40 which is also used to rotatably support the workpiece support 12 and the spray unit 8A, 8B.

When the cleaning fluid is introduced into the treatment vessel 1 under excess pressure, three different cleaning processes take place. The treatment fluid explosively and spontaneously evaporates in the space 52 above the liquid bath when the liquid jets impinge on the workpieces, whereby contaminants, adhering dirt and surface contamination are dislodged by the released energy. The pressure of cleaning fluid which is preferably in the range from 2.0 to 15.0 bar, can be matched to the vacuum generated in the space 52, which is preferably between 0.2 to 0.6 bar, so that evaporation occurs only when the cleaning fluid impinges on the workpieces. To improve the cleaning effect, the cleaning fluid is heated to a temperature of approximately 60 to 85° C. Introduction of the cleaning fluid into the liquid bath 50 causes a turbulent underwater flow which produces a cleaning effect on the workpieces. In addition, a gaseous medium may be introduced under an excess pressure through the other one of the two tubing loops of the spray unit 8A, 8B, whereby the gaseous medium creates additional turbulence in the liquid bath 50.

By rotating the workpiece support 12 about the axis A–A', the workpieces held in the basket 18 are presented alternately to the different cleaning processes in the space 52 above the liquid bath as well as in the liquid bath 50. Furthermore, by rotating the workpiece support 12, the workpieces of the charge contained in the basket 18 permanently intermix, so that during the cleaning process all workpieces are exposed to the cleaning processes acting on the charge from the outside. In the space 52 above the liquid bath, the workpieces are exposed from different directions to the liquid jets exiting from the discharge nozzles due to the rotation of the workpiece support 12. In this case, the spray unit 8A, 8B may be stationary, with a portion of the tubing loops 8A, 8b arranged above the liquid level 100, 102 and another portion of the tubing loops 8A, 8b arranged below the liquid level 100, 102 in order to inject cleaning fluid both into the space 52 and into the liquid bath 50. Advantageously, the spray unit 8A, 8B rotates during the cleaning process in the opposite direction of the workpiece support 18 above the axis A–A'.

The rotation of the workpiece support 12 causes in the liquid bath 50 an additional turbulent flow which enhances the cleaning effect. Moreover, the rotation of the workpiece support 12 permanently introduces into the liquid bath 50 gaseous components in the form of gas bubbles having different characteristics and enhancing cleaning of the workpieces.

Particularly efficient cleaning with this method takes place in the boundary region between the gas space 52 in the liquid gas 50. Continuous spontaneous evaporation and condensation occurs in this transition region between the liquid and the gaseous state, since the surface tension of the cleaning fluid in the transition state to the gas phase is optimally reduced and thereby enables introduction of the cleaning fluid even into capillary fissures and openings of the workpieces. The evaporation of the cleaning fluid in this boundary region is enhanced by the cleaning jets impinging on the liquid surface which causes a permanent agitation of the liquid surface.

During the cleaning process, the liquid vapors collecting in the gas space 52 are permanently withdrawn through the first suction port 7 by the vacuum pump. In order to keep the desired liquid level at least approximately constant in spite of the addition of liquid cleaning fluid through the spray unit 8A, 8B, a corresponding quantity of the liquid bath 50 which corresponds to the quantity of cleaning fluid added per unit time, is withdrawn through the liquid discharge port 4. The liquid discharge port 4 has a valve (not shown in the Figures) which is opened and closed at regular time intervals for discharging the liquid. Continuously discharging a quantity of cleaning liquid from the liquid bath 50 which corresponds to the quantity of cleaning fluid added through the spray unit 8A, 8B, has the advantage that during the cleaning process contamination and dirt which collects in the liquid bath 50, is permanently removed.

The cleaning process described above is preferably carried out several times in succession, wherein between the individual processes the liquid bath 50 is discharged at least partially and very rapidly through the liquid discharge port 4. This creates a strong suction on the workpieces which entrains residual contaminants adhering to the workpieces. The discharge of the liquid bath 50 is advantageously accelerated by generating an excess pressure using the compressed air introduced through the spray unit.

The device according to the invention can also be used to dry workpieces that are wet following the cleaning process. After the cleaning process is completed, the cleaning fluid is discharged through the liquid discharge port 4 and the liquid discharge port 4 is closed. A gaseous medium, in particular air, is then blown in into the treatment vessel 1 under excess pressure. The liquid residues adhering to the workpieces are dislodged by the gas jet and evaporate, with the so formed liquid vapor preferably removed by the vacuum pump through the first suction port 7. Moreover, a reduced pressure generated in the treatment vessel 1 by the vacuum pump accelerates the evaporation of the liquid residues released from the workpieces. The workpieces are permanently intermixed by rotating the workpiece support 18, whereby the gas jet for drying a workpiece are applied from different sides. Preferably, the workpiece support 18 and the tubing loop 8*b* rotate in a direction opposite to the treatment vessel about the axis A–A'.

Figure 4:
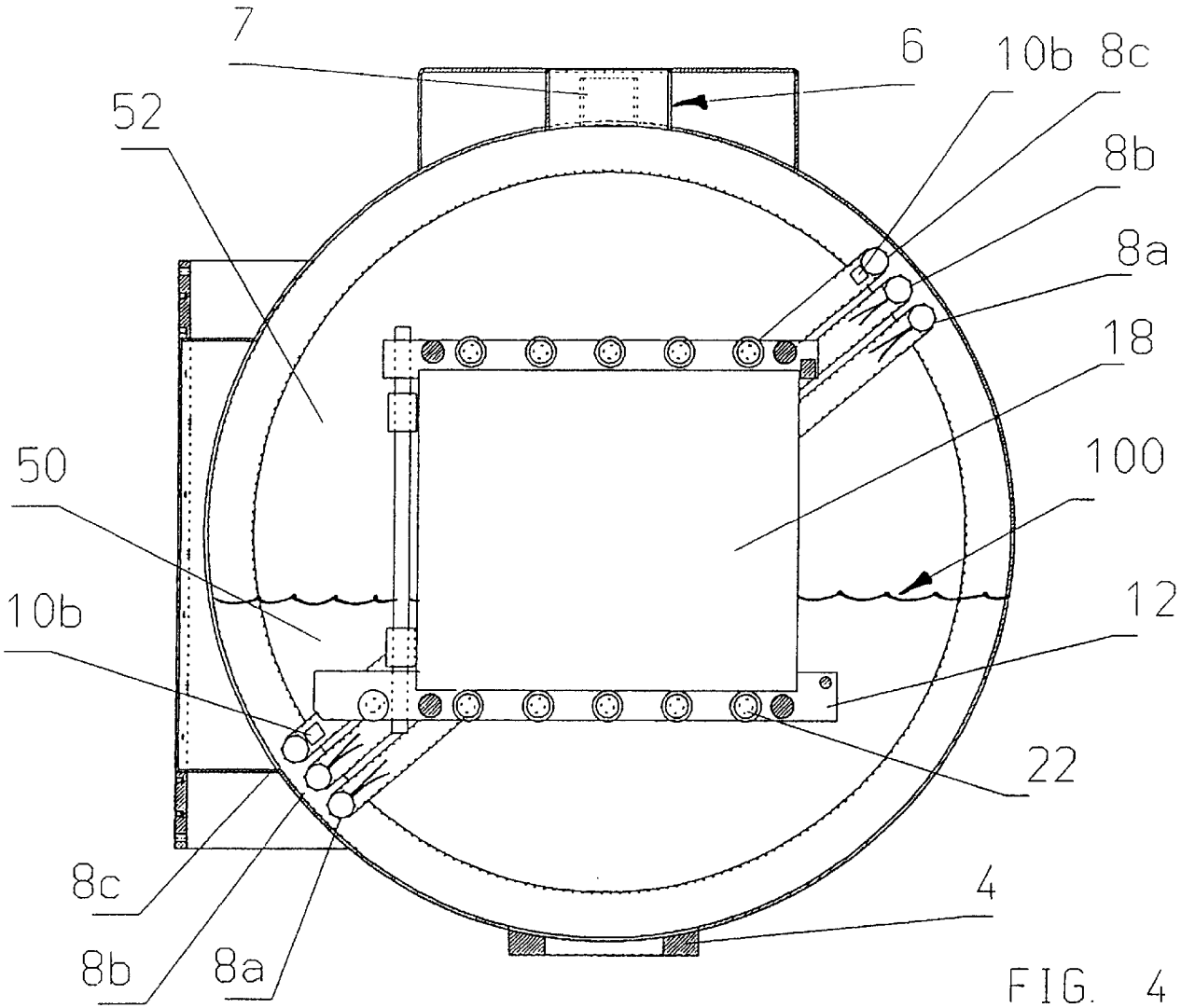
FIG. 4 a radial cross section of the device according to the invention according to a second embodiment with rotatable heat radiators.
Figure 5:
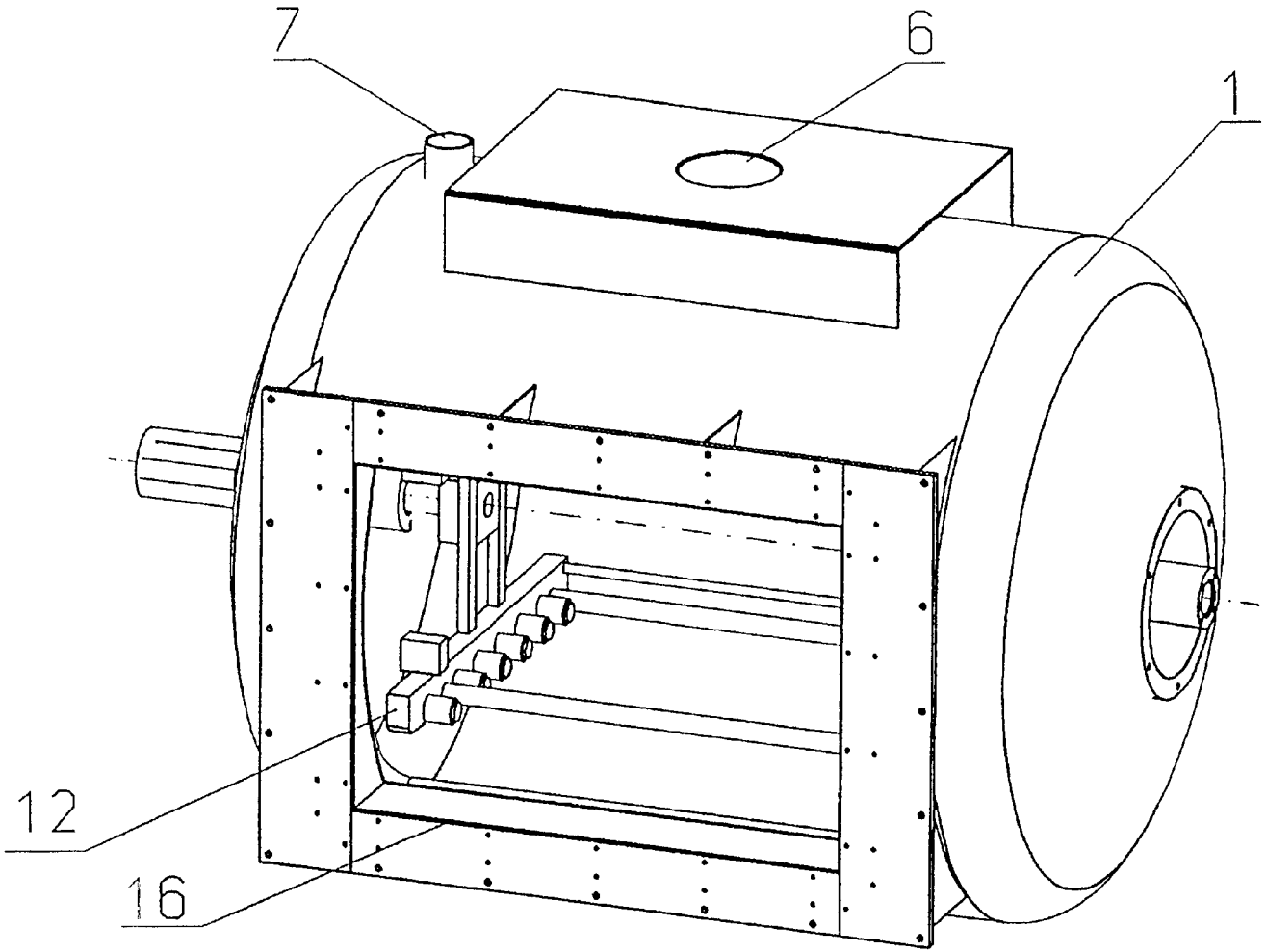
FIG. 5 a perspective view of the device according to the invention.

The drying effect is enhanced by heating the inside of the container, wherein heat is produced using heating devices (not described in detail) attached to the outside of the container, or heat radiators 10*a*, 10*b* disposed inside the vessel. The heat radiators are preferably directed toward the workpiece support or the workpieces, respectively, and may be arranged as stationary heat radiators 10*a* on an inside wall of the vessel, as illustrated in FIGS. 1 and 3. Alternatively, as illustrated in FIG. 4, the heat radiators 10*b* may be rotatable and disposed on a tubing loop 8*c* which is arranged parallel to the tubing loops 8*a*, 8*b* of the spray unit. The tubing loop 8*c* is rotatably supported together with the spray unit 8*a*, 8*b* for rotation about the axis A–A' of the treatment vessel. The heat radiators 10*a*, 10*b* are, as illustrated with particularity in FIG. 1, formed as elongated elements extending in an axial direction inside the treatment vessel 1.

In particular with sensitive workpieces, the workpiece support 12 may preferably remain stationary, whereas only the spray unit 8*a*, 8*b* or the spray unit 8*a*, 8*b* in conjunction with the tubing loop 8*c* supporting the heat radiator 10*b* rotate about the workpiece.

Before the actual drying process is carried out, the liquid vapors which may still reside in the cleaning vessel 1 from the cleaning process, are removed through the second suction port 6. This accelerates the drying process since the suction device connected to the second suction port 6 enables a greater gas exchange than the vacuum pump.

Depending on the temperature sensitivity of the workpieces to be dried, the temperature of the gaseous medium introduced through the spray unit 8*a*, 8*b* can be between 50 and 200° C. The pressure of the introduced gaseous medium varies accordingly between 0.5 bar and 10 bar, with a vacuum between 0.2 bar and 0.6 bar generated inside the vessel.

A second drying process can be carried out with the device of the invention, wherein the workpieces are dried by a combination of the radiant heat radiated by the heat radiators 10*a*, 10*b* and the vacuum produced by the vacuum pump. This method is particularly suitable for drying specific components, such as electronic components, which should not be mechanically stressed and which may be destroyed by the high pressure of the gas jet employed in the aforedescribed drying process.

The liquid residues adhering to the workpieces are evaporated by the radiant heat, wherein the boiling point is reduced significantly by the vacuum. In the case of stationary heat radiators, the workpiece support 18 is rotated to expose the workpieces to the radiant heat from all sides. With the device illustrated in FIG. 4, the heat radiator 10*b*can be rotated with the tubing loop 8*c* above the workpiece support 18, while holding the workpiece support 18 in a stationary position. Alternatively the workpiece support 18 and the tubing loop 8*c* can be rotated in opposite directions in order to continuously expose the workpieces to the radiant heat from different directions.

The liquid vapor formed inside the vessel is withdrawn through the first suction port 7 and the vacuum pump. Preferably, a gaseous medium, in particular air, is introduced briefly at predetermined time intervals through one of the tubing loops of the spray unit 8*a*, 8*b* into the inside of the vessel to temporarily increase the pressure in the vessel and to thereby weaken the vacuum. To reestablish the vacuum, the introduced air is removed with the vacuum pump. This temporarily enhanced gas exchange removes the liquid vapors more quickly from the treatment vessel 1. The introduced air also causes the liquid residues to be dislodged from the workpieces, so that the adhering liquid residues evaporate more quickly.

What is claimed is:

1. A device for cleaning workpieces comprising:

a treatment vessel;

a workpiece support arranged in the treatment vessel, and a spray unit arranged in the treatment vessel and comprising at least one discharge nozzle for discharging at least one of a cleaning fluid and a gaseous medium, wherein at least one of the workpiece support and the spray unit is arranged so as to be rotatable in the treatment vessel and wherein a reduced pressure can be generated in the treatment vessel, the treatment vessel comprising a controllable liquid port having a valve which can be opened and closed periodically, for maintaining at least approximately a constant fluid level of a liquid bath which at least partially surrounds the workpieces.

2. The device of claim 1, wherein the treatment vessel comprises a first suction port for connection of a vacuum pump.

3. The device of claim 2, wherein the treatment vessel comprises a second suction port.

4. The device according to claim 1, further comprising at least one heat radiator arranged in the treatment vessel and directed towards the workpiece support.

5. The device of claim 4, further comprising a rotation device, wherein the heat radiator is arranged in the treatment vessel so as to be rotatable with the help of the rotation device.

6. The device according to claim 1, wherein the treatment vessel comprises at least one heating device arranged on an outside region of the treatment vessel.

7. A method for cleaning workpieces wherein the workpieces are introduced into a treatment vessel in which a workpiece support for receiving the workpieces is arranged, and wherein a cleaning fluid is introduced into the treatment vessel under excess pressure through discharge nozzles of a spray unit directed towards the workpieces, the method comprising:

providing a liquid bath in the treatment vessel the liquid bath at least partially surrounding the workpieces;

generating a reduced pressure in a gas space located above the liquid bath;

moving the workpiece support in the treatment vessel in such a way that the workpieces alternately pass the liquid bath and the gas space formed above the liquid bath.

8. The method of claim 7, wherein a liquid level of the liquid bath is maintained at an at least approximately constant level.

9. The method of claim 7 wherein the workpiece support for alternately exposing the workpieces to the liquid bath and the gas space is rotated about an axis of the treatment vessel.

10. The method according to claim 7, wherein liquid vapors are removed from the gas space by suction.

11. The method according to claim 7, wherein the spray unit rotates preferably in a direction opposite to the rotation direction of the workpiece support in the treatment vessel.

12. The method according to claim 7, wherein the liquid bath is at least partially discharged at regular time intervals.

13. The method according to claim 7, further comprising drying the workpieces by:

removing the cleaning fluid from the treatment vessel;

introducing into the treatment vessel a gaseous medium under an excess pressure through the discharge nozzles of the spray unit;

removing liquid vapors from the inside of the treatment vessel by suction; and rotating the at least one of the spray unit and the workpiece support in the treatment vessel.

14. The method of claim 13, wherein a reduced pressure is generated in the treatment vessel.

15. The method of claim 13, wherein an inside of the treatment vessel is heated by heat radiators which are disposed on an outside region of the treatment vessel and directed towards the workpiece support.

16.The method of claim 13, wherein an inside of the treatment vessel is heated by heat radiators which are disposed on an inside region of the treatment vessel and directed towards the workpiece support.

17. Method for drying workpieces comprising:

generating a reduced pressure in a treatment vessel in which a workpiece support receiving workpieces is arranged;

generating radiant heat directed towards the workpieces with heat radiators arranged in the treatment vessel;

rotating at least one of the workpiece support and a device supporting the heat radiators in the treatment vessel; and introducing a gaseous medium into the treatment vessel under an excess pressure.

* * * * *